United States Patent [19]

Tidmore

[11] Patent Number: 4,592,492

[45] Date of Patent: Jun. 3, 1986

[54] BELLOWS-TYPE CONTAINER FOR LIQUIDS

[76] Inventor: Richard D. Tidmore, Rte. 2, Box 777, Ft. Gibson, Okla. 74434

[21] Appl. No.: 366,430

[22] Filed: Apr. 8, 1982

[51] Int. Cl.[4] ..... B65D 37/00

[52] U.S. Cl. ..... 222/209; 222/212

[58] Field of Search ..... 222/206, 210, 212, 213, 222/416, 105, 207, 211, 204, 209, 481, 481.5; 215/4, 5; 137/123, 150, 142, 143; 383/2; 604/37, 216

[56] References Cited

U.S. PATENT DOCUMENTS

| | | | |
|---|---|---|---|
| 754,132 | 3/1904 | Fulton | 222/204 |
| 1,053,816 | 2/1913 | Hughes | 222/416 |
| 1,752,085 | 3/1930 | Hinkle | 222/212 |
| 2,105,957 | 1/1938 | Severson | 215/4 |
| 2,228,435 | 1/1941 | Binon | 222/209 |
| 2,456,850 | 7/1969 | Uhlmann | 222/211 |
| 2,483,656 | 10/1949 | Marschalk | 222/213 |
| 2,738,107 | 3/1956 | Graham | 222/211 |
| 2,851,201 | 9/1958 | Poitras et al. | 222/416 |
| 2,909,305 | 10/1959 | Opsitnik | 222/481 |
| 2,991,911 | 7/1961 | Spain | 222/416 |
| 3,172,577 | 3/1965 | Hartung | 222/206 |
| 3,557,788 | 1/1971 | Swartz | 604/216 |
| 3,938,514 | 2/1976 | Boucher | 222/206 |
| 3,989,169 | 11/1976 | Bigley et al. | 222/207 |
| 4,098,434 | 7/1978 | Uhlig | 222/212 |
| 4,259,954 | 4/1981 | Scott | 222/213 |

FOREIGN PATENT DOCUMENTS

| | | | |
|---|---|---|---|
| 174644 | 1/1917 | Canada | 222/206 |
| 703528 | 2/1965 | Canada | 222/209 |
| 781494 | 3/1935 | France | 604/216 |

*Primary Examiner*—Joseph J. Rolla
*Assistant Examiner*—Kenneth Noland
*Attorney, Agent, or Firm*—Head, Johnson & Stevenson

[57] ABSTRACT

A container for transferring a liquid from one container or reservoir to another and comprising a bellows-type body having a closed bottom plate and a pair of outlet ports in the proximity of the upper end thereof, a tube extending through one of the outlet ports and having one open end disposed in the interior of the container and the opposite open end adapted for insertion with a liquid reservoir, a double seated valve provided in the other of said outlet ports to control the passage of air into and out of the interior of the container, the bellows-type construction of the container providing an automatic siphoning action for withdrawing liquid from the reservoir into the container, or permitting a manual pumping action for transferring the liquid from the reservoir into the container and ultimately emptying the liquid from the container, the transfer processing being accomplished in a manner substantially precluding contact between the liquid and the atmosphere surrounding the liquid transfer container.

4 Claims, 3 Drawing Figures

BELLOWS-TYPE CONTAINER FOR LIQUIDS

BACKGROUND OF THE INVENTION

1. Field of the Invention

This invention relates to improvements in containers for liquids and more particularly, but not by way of limitation, to a bellows-type container for facilitating the transfer of a liquid from one container to another.

2. Description of the Prior Art

It is frequently desirable to transfer liquids from one container to another, and in many instances it is extremely important to preclude contact between the liquid being transferred and the atmosphere, such as in the handling of gasoline, acids, toxic chemical, or the like. For example, it is often desirable to siphon gasoline from a storage tank into a second container, and spilling of the gasoline may be hazardous in that the gasoline is flammable and may explode or burst into flame under certain ambient conditions. At the present time, it is difficult to transfer liquids of this nature from one container to another, and the most prevalent manner for achieving such transfer is by a careful pouring of the liquid between the containers, or siphoning of the liquid from one container to another. In the pouring operation, the liquid is usually exposed to the atmosphere, and in the siphoning operation, it is common practice to utilize a tube having the opposite open ends disposed in the two containers for transfer of the liquid between the containers. Of course, some type of force must be applied to the interior of the tube for initiating the movement of the fluid from one tank to the other, and this is normally an awkward and difficult task.

SUMMARY OF THE INVENTION

The present invention contemplates a novel bellows-type container particularly designed and constructed for transferring liquids from one container to another in a manner precluding contact of the liquid with the surrounding atmosphere. Whereas bellows-type containers are known, such as those shown in the Hasselquist U.S. Pat. No. 2,686,006; the Hartung U.S. Pat. No. 3,172,577; and the Adair U.S. Pat. No. 3,875,941, none have achieved the results of the present novel liquid transfer container. The Hasselquist U.S. Pat. No. 2,686,006, issued Aug. 10, 1954, discloses a pneumatic bellows pump comprising a plurality of compartments encased by individual folds of the bellows, with a membrane or wall being interposed between each compartment. In one embodiment, ball valve means is provided in the wall for communicating air between successive compartments, and in another embodiment, each membrane or wall is provided with a central opening for passage of air therethrough during operation of the pump. The outermost compartments are each provided with ports open to the exterior of the bellows. The first of the ports may be selectively closed by placing of the operator's hand over the port, and the second of the ports is provided with a conduit in communication with the interior of an article to be inflated by the pump. As the bellows is expanded manually, air is drawn into the interior thereof through the open first port for filling the bellows. As the bellows is compressed manually, the first port is closed, and the air within the bellows is expelled through the conduit for inflating the object connected therewith.

The Hartung patent relates to a combination storage and dispenser bottle for liquids and is provided with a collapsible bellows type body and discharge nozzle integral with the neck of the bottle for expelling liquids from the interior of the bottle. As the bellows is compressed a portion of the liquid contained therein is forced outwardly through the discharge nozzle, and when the bellows is in the normal expanded position thereof, the bottle may be utilized for storage of the liquid contents. The Adair patent shows a bellows-type activation system for removing accumulated fluids from the body of a patient through a vacuum process, the body fluids being captured in the bellows-type container. The folds of the bellows may be completely compressed, and as the bellows returns naturally to its extended position, a constant vacuum is provided for starting a body fluid drainage operation. In addition, the bottle is provided with a rigid handle at the top thereof to facilitate suspending of the bottle in a normal vertical position, and whereby the bottle may be easily carried by an ambulatory patient without spillage.

The present bellows-type liquid transfer container comprises a body of a bellows-type construction, and having a closed bottom and first and second outlet ports in the proximity of the top thereof. A suitable conduit or tube extends through one of the outlet ports, with the opposite ends of the tube being open to provide communication between the interior of the container and the exterior thereof. The second of the outlet ports is provided with a suitable check valve means for control of the admission of air into the interior of the container during use thereof. When liquid is to be transferred from one container to another, such as when it is desired to siphon gasoline from a vehicle gas tank into another container, the open outer end of the tube may be inserted into the reservoir or gasoline, and the transfer container may be positioned on a suitable support surface in the proximity of the gasoline reservoir. If the transfer container is disposed at an elevation below the elevation of the gasoline reservoir, it is preferable to initially place the transfer container in the collapsed position of the bellows-type construction, and as the bellows follow the natural action thereof for returning to the expanded position thereof, a vacuum will be created within the transfer container for automatically siphoning the gasoline from the reservoir into the interior of the transfer container. It will be apparent that the gasoline will not be exposed to the atmosphere since both ends of the transfer tube are protected from the atmosphere. In addition, the check valve means in the second port of the transfer container precludes accidental discharge of the gasoline from the interior of the transfer container.

In the event the transfer container is disposed at an elevation higher than the elevation of the gasoline reservoir, it may be preferable to manually move the transfer container between the expanded or extended and collapsed positions thereof to provide a pumping action for withdrawing the gasoline from the reservoir and into the transfer container. Of course, if the gasoline accumulated within the transfer container is then to be discharged into a second reservoir for the gasoline, or a second container, the transfer container may be manually moved from the expanded position toward the collapsed position for expelling the gasoline from the interior thereof through the conduit or tube means, with the outer end of the tube being disposed within the container or reservoir to which the gasoline is to be transferred. The novel liquid transfer container is simple and efficient in operation and economical and durable in construction.

DETAILED DESCRIPTION OF THE PREFERRED EMBODIMENT

Figure 1:
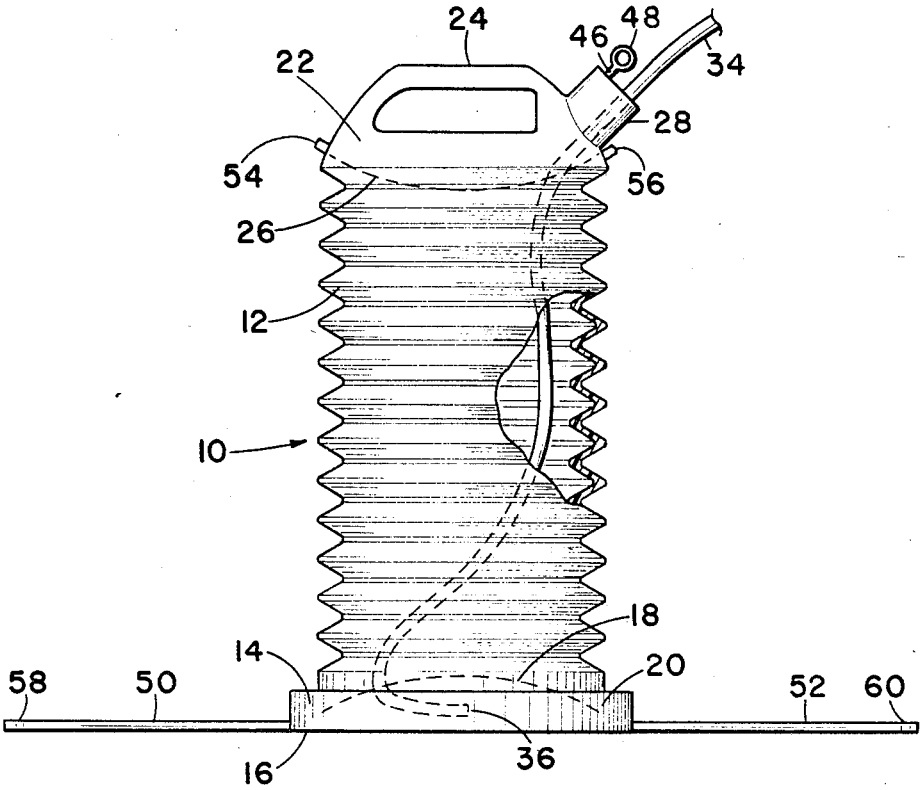
FIG. 1 is a side elevational view of a liquid transfer container embodying the invention in an extended position thereof, with a portion thereof shown in section for purposes of illustration.
Figure 2:
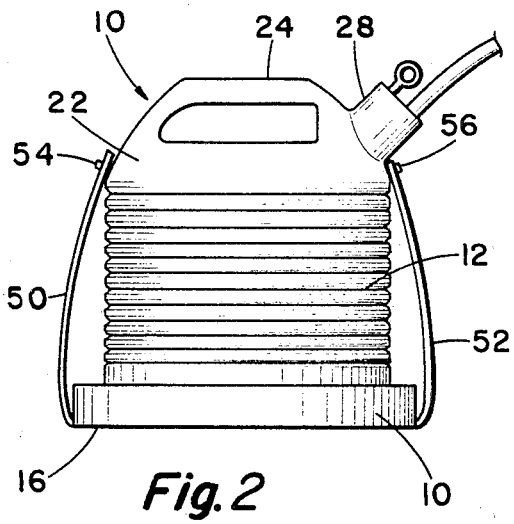
FIG. 2 is a side elevational view of a liquid transfer container embodying the invention and shown in the collapsed position thereof.
Figure 3:
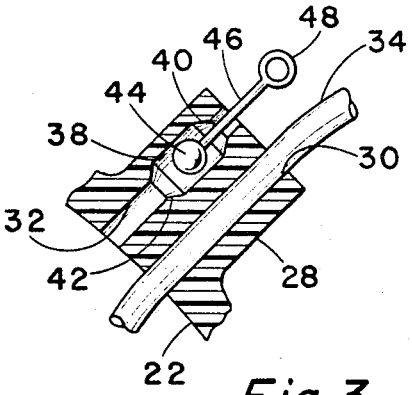
FIG. 3 is an enlarged sectional view of the outlet ports of a liquid transfer container embodying the invention.

Referring to the drawings in detail, reference character 10 generally indicates a liquid transfer container comprising a central body portion 12 of a bellows-type construction movable between an extended position as shown in FIG. 1 and a collapsed position as shown in FIG. 2. The body 12 is preferably constructed from a suitable plastic material which is impervious to damage from caustic liquids, or the like, but not limited thereto. One end of the body 12 is secured to or integral with a bottom plate 14 having the outer end 16 thereof substantially flat for stability of support for the container 10 during use thereof as will be hereinafter set forth. The inwardly directed surface 18 of the bottom 12 is preferably of a convex configuration as shown in broken lines in FIG. 1, thus providing an annular chamber 20 in the bottom portion of the interior of the body 12. The opposite end of the body 12 is secured to or integral with a cover member 22 which is preferably provided with a handle means 24 at the upper end thereof for facilitating manipulation of the liquid transfer container 10. In addition, the inner surface 26 of the cover member 22 is preferably of a convex configuration as shown in broken lines in FIG. 1 and extending in a direction toward the convex surface 18 of the bottom plate 14.

A boss member 28 extends angularly outward from the cover member 22 and is provided with first and second passageways 30 and 32 extending longitudinally therethrough providing communication between the interior of the body 12 and the exterior of the container 10. A flexible tube 34 extends through the first passageway 30 and may be secured therein in any suitable manner (not shown). The opposite ends of the tube 34 are open, with one end 36 being disposed within the interior of the body 12 and open thereof, and the opposite end (not shown) being spaced from the outer periphery of the container 10 a sufficient distance for insertion with substantially any desired liquid reservoir (not shown), for a purpose as will be hereinafter set forth.

The passageway 32 is preferably provided with an enlarged portion 38 therein having oppositely disposed spaced valve seats 40 and 42 provided at the opposite ends thereof. A suitable closure member, such as a ball 44 is loosely disposed within the enlarged portion 38 and movable between the valve seats 40 and 42 to provide a double sealing valve for the passageway 32. In addition, a suitable valve actuator, such as a stem 46 may be secured to the ball 44 in any well known manner (not shown) and extends outwardly therefrom through the passageway 32 and beyond the outer end of the boss 28. It may be desirable to provide an eye member 48, or the like, at the outer end of the stem 46 for facilitating manipulation of the ball member 44 during operation of the transfer container 10.

It may be desirable to provide means for holding the body 12 in the collapsed position thereof while the container 10 is in storage or not in use, as shown in FIG. 2. In this event, a pair of outwardly extending oppositely disposed flaps 50 and 52 may be secured to the bottom plate 14 or integral therewith, as desired. In addition, a pair of oppositely disposed outwardly extending projections or buttons 54 and 56 may be provided on the outer periphery of the cover member 22. The flaps 50 and 52 are preferably provided with apertures 58 and 60 in the proximity of the outer ends thereof for receiving the buttons 54 and 56, respectively, therein. When the body 12 is collapsed, the flaps 50 and 52 may be moved to a position in the proximity of the outer periphery thereof and engaged with the buttons 54 and 56, thus holding the cover 22 in the lowered position thereof. When the container 10 is to be used, the apertures 58 and 60 may be released from the engagement with the buttons 54 and 56, and the body 12 may be expanded in the usual manner.

It will be apparent that the ratio between the height of the body 12, including the cover 22, and the diameter or width of the bottom 14 may be selected to provide for optimum stability for the container 10 when filled with a liquid. In addition, the rigidity of the material from which the bellow configuration of the body 12 is constructed may be selected to provide sufficient flexibility for the bellows action while providing sufficient strength for facilitating support of the container 10 in the extended position thereof.

When the liquid transfer container 10 is to be utilized for transferring a liquid from one container to another, such as for siphoning gasoline from a gasoline tank of a vehicle or the like (not shown), the container 10 may be placed on a suitable support such as a floor, the surface of the ground, or the like, preferably at a position lower than the elevation of the reservoir, and the open outer end of the tube 34 may be inserted into the gasoline reservoir in the vehicle tank. If the container 10 is provided with the locking flaps 50 and 52 and buttons 54 and 56, the flaps may be disengaged from the buttons, freeing the bellow-type body 12 from the collapsed position thereof. As the bellows expand a vacuum is created within the body 12. This vacuum is transmitted through tube open end 36 of the tube 34 and through the tube to the gasoline reservoir (not shown) thus drawing the gasoline from the reservoir and into the interior of the body 12. As soon as the gasoline begins to move from the initial reservoir into the interior of the body 12, the fact that the container 10 is positioned at an elevation lower than the elevation of the reservoir will cause the siphon action to continue, and as the gasoline accumulates within the body 12, the air within the body will be expelled through the open valve 44. When the level of the gasoline approaches the passageway 32 or rises therein, the gasoline will lift the ball 44 into a closed position against the valve seat 40, thus precluding any accidental spillage of the gasoline from the container 10. The supply of gasoline may be stored in the container 10, or may be discharged from the container 10 into another storage container (not shown), as desired.

When the contents of the container 10 are to be discharged therefrom, the cover member 22 may be manually moved in a direction toward the bottom plate 14 for collapsing the bellows-type body 12. This forces for gasoline outwardly through the tube 34 for discharge from the open outer end there, which may be placed within the second liquid reservoir (not shown) to which it is desired to transfer the gasoline. The closed position of the ball member 44 against the valve seat 40 precludes discharge of the fluid from the passageway 32.

In order to substantially completely purge the liquid from the interior of the body 12, the cover 22 may be manually moved to a position of engagement between the convex surfaces 18 and 26, thus providing a minimum internal volume for the container 10. The tube 34, being flexible, will accumulate around or in the annular chamber 20 in the proximity of the bottom of the interior of the body 12. When the container 10 has thus been emptied, and it is desired to store the container in the collapsed position, the flaps 50 and 52 may be engaged with the buttons 54 and 56, as shown in FIG. 2 whereby the container will be securely retained in the storage position thereof.

In the event the container 10 is placed at an elevation higher than the elevation of the liquid reservoir from which the liquid is to be transferred, the body 12 may be forced to the collapsed position therefor. The ball member 44 thereafter being in a closed position with respect to the valve seats 42. The user then manually pulls the cover member 22 in a direction away from the bottom plate 14. This action creates a sufficient vacuum within the body 12 for pulling the liquid from the reservoir into the interior of the body. If necessary, the cover 22 may be moved reciprocally with respect to the bottom plate 14 to provide a pumping action for drawing the liquid into the interior of the body 12.

The body 12, bottom plate 14, cover member 22 and boss 28 are preferably of a one piece construction and made from an injection molding operation and is preferably utilized mainly for transferring liquids rather than a storage container, but it is to be understood that liquids may be stored in the container, at least temporarily, if desired. In addition, wherein the bellows configuration of the body 12 shown herein is of a conventional or corrugated type, it is to be understood that the folds of the bellows may be of a configuration for stacking one within the other in the collapsed position of the body 12, if desired.

From the foregoing it will be apparent that the present invention provides a novel container for transferring liquids from one container or reservoir to another in a manner substantially precluding contact of the liquid with the atmosphere during the transferring operation. The liquid transfer container is of a bellow-type construction and may be either used in the manner of a siphon for transferring the liquid from a reservoir or delivering liquid to a reservoir, or may be utilized in a manual pumping type action to provide said liquid transfer.

Whereas the present invention has been described in particular relation to the drawings attached hereto, it should be understood that other and further modifications, apart from those shown or suggested herein, may be made within the spirit and scope of this invention.

What is claimed is:

1. A container for transferring liquids from one reservoir to another comprising:

a cylindrical vessel having a bellows-type cylindrical wall and a top and bottom end, the bottom end being closed and the top end having a valve opening and a tube opening therein, the valve opening being defined by an internal chamber having a reduced diameter upper and a reduced diameter lower opening, the lower opening communicating with the interior of the vessel and the upper opening communicating with the vessel exterior;

a ball received in said valve opening chamber, the ball being of external diameter less than the internal diameter of said valve opening chamber and larger than said upper and lower openings;

an elongated stem affixed at one end to said ball and extending externally of said vessel through said reduced diameter upper opening, the stem being of diameter less than said upper opening, the stem being of small weight and size so as not to interfere with the normal propensity of the ball to automatically seal against said upper and lower openings as moved by the force of air or fluid tending to flow through said valve opening but affording means whereby the ball can be manually positioned to let air in or out of the vessel as desired; and a tube sealably received in said tube opening, one end of the tube being adjacent the interior bottom of the vessel and the other end being spaced a distance from the vessel exterior and adapted to extend within another vessel as the container is used.

2. A container as set forth in claim 1 wherein the internal surface of one end of the body means is of a convex configuration, and the surface of the opposite end of the body means is of an oppositely disposed convex configuration for facilitating purging of the liquid from the interior of the body means during emptying of the container.

3. A container as set forth in claim 2 wherein said cooperating convex surfaces provide an annular chamber in the body means for receiving the tube means therein in the collapsed position of the bellows-type body means.

4. A container for transferring liquids from one reservoir to another according to claim 1 including:

opposed flexible straps, each strap having one end affixed to said vessel adjacent the bottom thereof, the other end of each strap being free;

opposed attachment means secured to said vessel adjacent the top thereof; and means of releasably securing said strap free ends to said attachment means whereby said straps can be employed to retain said vessel in a collapsed condition.

* * * * *